US010767531B2

(12) United States Patent
Marini et al.

(10) Patent No.: US 10,767,531 B2
(45) Date of Patent: Sep. 8, 2020

(54) OPERATING LIQUID TANK WITH PUMP ASSEMBLY OF MULTI-PART CONSTRUCTION

(71) Applicant: Röchling Automotive SE & Co. KG, Mannheim (DE)

(72) Inventors: Luca Marini, Besenello (IT); Ivan De Metri, Bolzano (IT); Fabrizio Chini, Isera (IT)

(73) Assignee: Röchling Automotive SE & Co. KG, Mannheim (DE)

( * ) Notice: Subject to any disclaimer, the term of this patent is extended or adjusted under 35 U.S.C. 154(b) by 109 days.

(21) Appl. No.: 15/606,114

(22) Filed: May 26, 2017

(65) Prior Publication Data

US 2017/0350297 A1 Dec. 7, 2017

(30) Foreign Application Priority Data

Jun. 2, 2016 (DE) ..... 10 2016 209 672

(51) Int. Cl.
*F01N 3/20* (2006.01)
*F04D 13/08* (2006.01)
(Continued)

(52) U.S. Cl.
CPC ..... *F01N 3/2073* (2013.01); *F01N 3/206* (2013.01); *F01N 3/2896* (2013.01);
(Continued)

(58) Field of Classification Search
CPC ..... F01N 3/206; F01N 3/2073; F01N 3/2896; F04D 13/024; F04D 13/08; F04D 13/086
(Continued)

(56) References Cited

U.S. PATENT DOCUMENTS 5,988,213 A * 11/1999 Yoshioka ..... F02M 37/106 123/509
6,634,342 B1 * 10/2003 Wouters ..... B60K 15/035 123/516

(Continued)

FOREIGN PATENT DOCUMENTS

DE 10323591 A1 12/2004
JP 2009-144644 * 7/2009

OTHER PUBLICATIONS

Espacenet Bibliographic data:DE10323591 (A1), Published Dec. 2, 2004, 1pgs.

(Continued)

*Primary Examiner* — Hai H Huynh
*Assistant Examiner* — Diem T Tran
(74) *Attorney, Agent, or Firm* — Rankin, Hill & Clark LLP

(57) ABSTRACT

An operating liquid tank for a motor vehicle, comprising a tank wall enclosing a tank volume that can be filled with an operating liquid, a filling arrangement designed for introducing operating liquid into the tank volume, and a removal arrangement designed for the removal of operating liquid from the tank volume, wherein the removal arrangement comprises a pump assembly with a pump and a pump drive, the pump assembly comprises at least two assembly components that are formed separately from one another and are or can be coupled magnetically to one another, and of which a first assembly component as drive component comprises at least one part of the pump drive and a second assembly component as conveying component comprises a conveying part of the pump that can be driven by the pump drive relative to a conveying component housing for movement, wherein the tank wall extends between the drive component and the conveying component and physically separates the (Continued)

conveying component located on the inner face of the tank wall from the drive component located on the outer face of the tank wall.

11 Claims, 2 Drawing Sheets

(51) Int. Cl.
*F01N 3/28* (2006.01)
*F04D 13/02* (2006.01)

(52) U.S. Cl.
CPC ..... *F04D 13/024* (2013.01); *F04D 13/08* (2013.01); *F04D 13/086* (2013.01)

(58) Field of Classification Search
USPC ..... 60/286, 303
See application file for complete search history.

(56) References Cited

U.S. PATENT DOCUMENTS

| | | | | |
|---|---|---|---|---|
| 8,955,308 | B2 | 2/2015 | Bauer | |
| 9,074,510 | B2 | 7/2015 | Bauer | |
| 2007/0006851 | A1* | 1/2007 | Okamura | F02D 41/40 123/478 |
| 2009/0230136 | A1* | 9/2009 | Dougnier | F01N 3/2066 220/592.01 |
| 2010/0050606 | A1* | 3/2010 | Fulks | F01N 3/2066 60/286 |
| 2011/0002798 | A1* | 1/2011 | Ford | B60K 15/077 417/410.1 |
| 2013/0071268 | A1* | 3/2013 | Ryoo | F04B 17/03 417/410.4 |
| 2013/0104528 | A1 | 5/2013 | Chmielewski et al. | |

OTHER PUBLICATIONS

German Search Report for corresponding DE 10 2016 209 672.9 dated Feb. 2, 2017, 9 pgs.

* cited by examiner

OPERATING LIQUID TANK WITH PUMP ASSEMBLY OF MULTI-PART CONSTRUCTION

The present invention relates to an operating liquid tank for a motor vehicle, comprising a tank wall enclosing a tank volume that can be filled with an operating liquid, a filling arrangement designed for introducing operating liquid into the tank volume, and a removal arrangement designed for the removal of operating liquid from the tank volume, wherein the removal arrangement comprises a pump assembly with a pump and a pump drive.

BACKGROUND OF THE INVENTION

Such an operating liquid tank is known, for example, from DE 10 2010 011 151 A1 as a tank for holding a reducing agent. The reducing agent may be, in particular, a urea solution. For the tank according to the present application a reducing agent, in particular an aqueous urea solution, is preferably also conceivable as the operating liquid, but the operating liquids that can be held in the tank should not be limited to such reducing agents.

A problem of the generic tank is the conveying of operating liquid out of the tank, in order to deliver the liquid to a place of use.

Several solutions for this are known in the prior art. For example, a conveying device together with its drive can be installed in a separate module, which module is then inserted into an opening in the tank wall and closes said opening. Firstly, this leads to a joining point in the region of the module arrangement and also leads to necessary seals on the module, in order to prevent operating liquid from reaching components of the pump assembly that are sensitive therefor. In this case especially the usual electrical pump drive should be kept away from the fluid.

According to another known solution, the pump drive is arranged outside the tank wall and the pump is arranged inside the tank wall, wherein a drive shaft of the pump drive then passes through the tank wall in order to transmit kinetic energy to the pump in order to drive it. This passage point should then be sealed particularly against leakage of liquid from the tank.

A further possibility consists of arranging the entire pump assembly outside the tank and connecting it to the interior of the tank by conduits that pass through the tank wall. Of all the three possibilities, this one leads to the greatest possible requirement for space, so that with a predetermined installation space for the operating liquid tank the storage volume that is actually usable is smallest in the last-mentioned solution.

SUMMARY OF THE INVENTION

It is therefore an object of the present invention to modify a generic operating liquid tank in such a way that, with low sealing costs and effective utilization of space, the secure storage of the largest possible volume of liquid and reliable conveying thereof out of the tank volume is made possible.

This object, and others, is achieved according to the invention by an operating liquid tank of the aforementioned type, wherein the pump assembly comprises at least two assembly components that are formed separately from one another and are or can be coupled magnetically to one another, and of which a first assembly component as drive component comprises at least one part of the pump drive and a second assembly component as conveying component comprises a conveying part of the pump that can be driven by the pump drive relative to a conveying component housing for movement, wherein the tank wall extends between the drive component and the conveying component and physically separates the conveying component located on the inner face of the tank wall from the drive component located on the outer face of the tank wall.

Due to the magnetic coupling of the drive component and the conveying component, the drive component and the conveying component can be arranged spatially separately on different faces of the tank wall without the tank wall having to be mechanically penetrated for transmission of driving force from the drive component to the conveying component. The magnetic coupling preferably takes place across the tank wall. Thus the separation of the drive component from the conveying component by the tank wall takes place without penetration. In the region in which it extends between the drive component and the conveying component the tank wall has no passage connecting the drive component and the conveying component to one another.

Since the tank wall separates the drive component and the conveying component spatially and physically from one another, the tank wall can form a part of the pump assembly housing. Thus the drive component is very reliably protected against contact with the operating liquid, which is advantageous in particular for the parts of the pump drive that are sensitive because they are frequently operated with electrical power.

Likewise, the conveying component with the conveying part that, during movement relative to the conveying component housing, conveys operating liquid can be safely brought into contact with operating liquid in order to ensure successful conveying.

In principle, the pump assembly can comprise more than the two aforementioned assembly components. As a rule, a preferred embodiment of the operating liquid tank according to the invention will comprise a pump assembly with precisely two assembly components in order to avoid an unnecessarily large number of components.

Due to the physical separation by the tank wall the two assembly components are completely separated from one another and are only coupled to one another magnetically, that is to say not physically.

The pump drive preferably comprises an electric motor that can be arranged in a very small space with sufficient power density. At least one stator of the electric motor can be arranged in the drive component. In this case the armature of the electric motor can be comprised by the conveying component, wherein the armature is preferably a rotor, but does not have to be. Therefore, the electric motor is preferably a rotating electric motor. In this case of a preferred embodiment of the operating liquid tank, the magnetic coupling between the drive component and the conveying component is implemented by the magnetic field existing between the stator and the rotor during operation of the electric motor. On the other hand, inside the conveying component the armature can be coupled to the conveying part mechanically so as to transmit torque and motion.

With this embodiment of the operating liquid tank an advantageously high force can be transmitted magnetically between the stator and the armature of the electric motor. In a preferred embodiment the armature can be equipped with permanent magnets, so that the armature itself does not require any electrical wiring and no electrical currents have to flow in the armature. This simplifies the sealing requirements between the conveying part and the armature in said embodiment.

According to an alternative embodiment of the operating liquid tank according to the invention, the drive component can also comprise the armature of the electric motor in addition to the stator, again preferably in the form of a rotor. In this case the electric motor is preferably completely accommodated in the drive component Thus the electric motor can be arranged completely outside the tank wall, which eliminates almost any risk that the electric motor could come into contact with operating liquid.

In the case of the most-recently discussed alternative embodiment, the mechanical coupling between the drive component and the conveying component thus exists between the armature and the conveying part. Therefore, the conveying component preferably comprises a magnetic coupling part that is connected to the conveying part so as to transmit movement. The transmission of movement between the coupling part and the conveying part can be achieved mechanically, for instance by a connecting shaft, in order to minimize losses and undesirable slippage.

The magnetic coupling part may be coupled or may be capable of being coupled to a magnetic field emanating directly from the armature, wherein the magnetic field on the armature side can be generated by a magnet arrangement of the armature, said magnet arrangement also being magnetically coupled to the magnetic field of the stator in order to be set in motion by the stator. Alternatively, the armature can be coupled, in particular mechanically coupled, to a magnetic counterpart coupling part so as to transmit movement, wherein the coupling part on the conveying component side and the counterpart coupling part on the drive component side produce the magnetic coupling of the drive component and the conveying.

Although it may be conceivable to distribute the pump over a plurality of components, for reasons of the simplest possible manufacture and assembly it is preferable if the conveying component comprises the complete pump. In the context of the present application any components that, in the event of relative movement with respect to a pump housing or conveying component housing, produce a conveying action in the operating liquid are designated as a "pump," wherein the pump drive should explicitly not be understood as part of the pump. The pump housing is part of the pump.

In order to ensure a sufficient sealing of the components accommodated in the conveying component, in particular when they comprise the armature, it is advantageous if the conveying component housing completely surrounds the conveying component with the exception of through openings for passage of operating liquid to the conveying part and away from it. In this case a section of the tank wall can form a section of the conveying component housing. Additionally or alternatively, a section of the tank wall can form a section of a drive component housing. In both cases this may be the same section of the tank wall.

The arrangement of the conveying component in the tank necessitates means by which the amount of liquid conveyed by the conveying component can be conveyed through the tank wall out of the interior of the tank into the outer region of the tank. For this purpose, the tank can comprise a conveying line that is led away from the conveying component through the tank wall. The passage may require a seal. However, the conveying line can be passed through the tank wall at any location that is not necessarily permanently wetted by operating liquid.

Therefore, the location of the passage for the conveying line through the tank wall is preferably provided in a region located above the nominal filling level when the tank is filled with a nominal amount of liquid. Thus the passage for the conveying line through the tank wall is only wetted with liquid temporarily and randomly, for instance when the liquid accommodated in the tank slops over to the passage due to impacts acting on the vehicle. Nevertheless, in this case a substantially less costly seal may be sufficient in order to permanently seal the passage for the conveying line completely and securely against an escape of liquid from the tank. However, the conveying line may also be passed through a side wall or through the base of the tank, and also in a section that is wetted with liquid permanently or during a significant period of operation.

In order to reduce the number of components required, a section of the conveying line can preferably be formed integrally with the tank wall. Additionally or alternatively, a section, preferably a further section of the conveying line, can be formed between the tank wall and a part of the conveying component housing. This is advantageous, in particular, if the conveying component housing comprises a housing connected, preferably in a fluid-tight manner, to a section of the tank wall. In this case the section, preferably the further section of the conveying line, can be formed between the tank wall and the housing component. During operation of the conveying component, the last-mentioned section of the conveying line preferably guides liquid to the conveying line section formed integrally with the tank wall.

For secure seating of the conveying component in the tank, the tank wall can have an outwardly projecting protuberance into which at least a section of the conveying component protrudes. Thus at least one section of the conveying component can be accommodated in the protuberance and can be connected, for example, by a bonding adhesive or a casting compound to a wall section of the protuberance can thereby be fixed in the tank. In order to accommodate the conveying component, the protuberance can preferably be formed cylindrically or conically or generally tapering away from the surrounding tank wall of the protuberance. The cylindrical or conical protuberance is preferred, since the conveying component usually contains rotating parts that describe a circular path when they are moving. Thus with efficient utilization of space these rotating components can be accommodated without collision in a cylindrical or conical section of the conveying component, so that at least this section can be inserted with a narrow gap or even without play into the protuberance.

With the protuberance a fixing formation for the drive component can be formed, so that at least one section of the drive component surrounds the protuberance radially externally, and preferably is fixed radially externally on the protuberance, for example again by adhesion or by casting of an annular gap between the outer face of the protuberance and the drive component.

Therefore, the protuberance can form a part of the drive component housing or/and a part of the conveying component housing.

The operating liquid tank can be formed from two or more tank shells in order to simplify its production.

Merely for the sake of completeness it may be pointed out that the filling arrangement can comprise an opening in the tank wall. In addition, the filling arrangement can comprise a filling pipe that either terminates flush with the tank wall or passes through the tank wall and protrudes into the tank volume in the interior of the tank. Furthermore, the filling arrangement can have one or more valves, in order to avoid slopping operating liquid out of the tank even if a user might have forgotten to close a filling opening after filling of the tank with a tank cap.

Furthermore, the filling arrangement can have a ventilating structure that is known per se, by means of which gas can escape out of the tank volume as it is being filled or by means of which gas can flow into the tank volume as operating liquid is gradually being removed from the tank.

The tank wall is preferably formed in one piece and is free of joints in the region of the pump assembly as well as in a region surrounding the pump assembly.

The present invention also relates to a motor vehicle with an operating liquid tank formed as described above, in particular as part of an injection system for carrying out a selective catalytic reduction in an exhaust gas system.

These and other objects, aspects, features and advantages of the invention will become apparent to those skilled in the art upon a reading of the Detailed Description of the invention set forth below taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DESCRIPTION OF PREFERRED EMBODIMENTS

Figure 1:
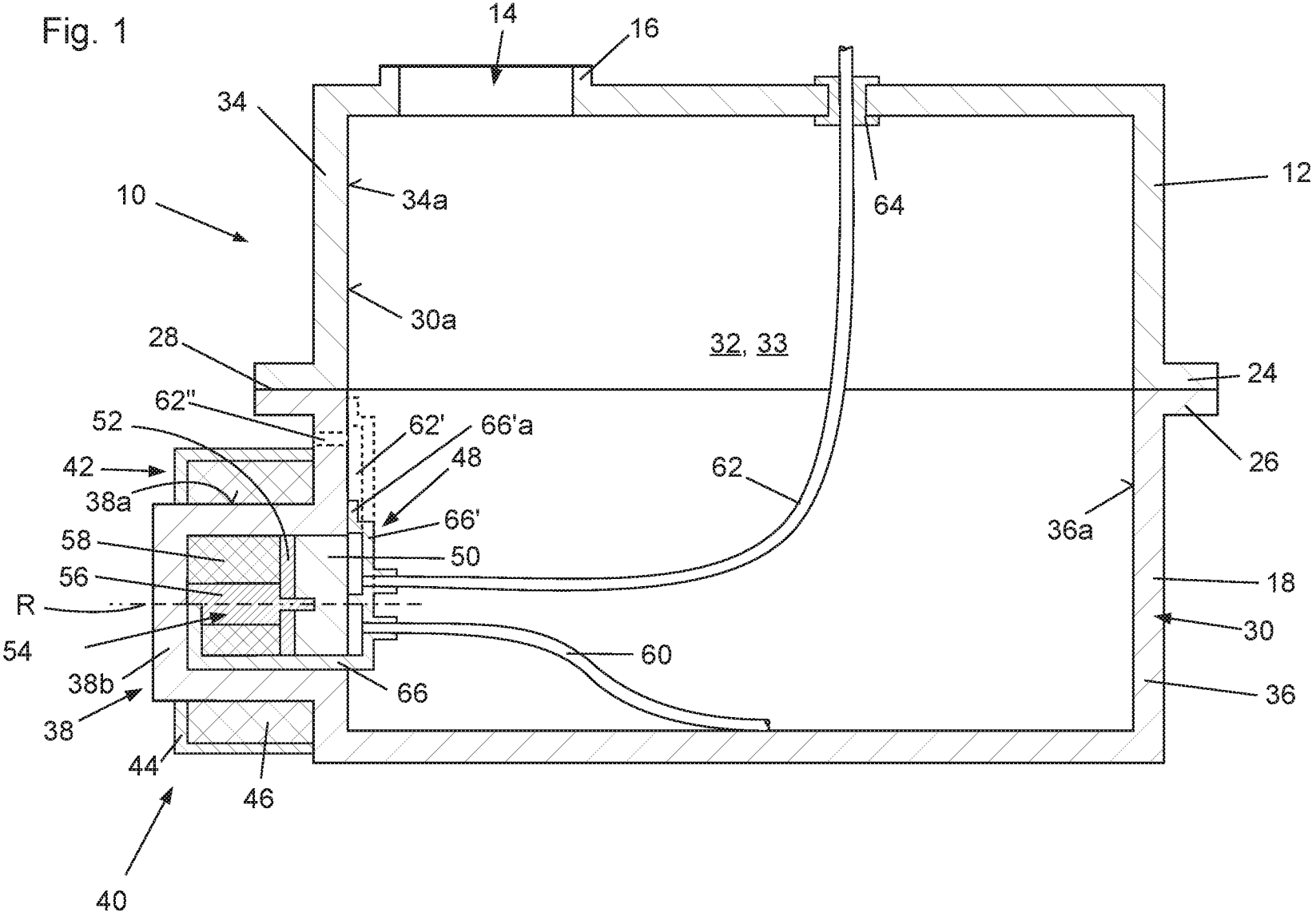
FIG. 1 shows a broadly schematic longitudinal sectional view of a first embodiment of an operating liquid tank according to the invention; and, FIG. 2 shows a broadly schematic longitudinal sectional view of a second embodiment of an operating liquid tank according to the invention.

Referring now to the drawings wherein the showings are for the purpose of illustrating preferred and alternative embodiments of the invention only and not for the purpose of limiting the same, a motor vehicle reducing liquid tank according to the invention (designated below only as a "liquid tank" or "tank") is designated generally by 10 in FIG. 1. The liquid tank 10 preferably comprises an upper shell part 12 that has a filling opening 14, with a flange rim 16 surrounding the filling opening 14. A filling line, for instance a filling pipe (not shown in FIG. 1), can be connected to the flange rim 16.

The liquid tank 10 is an SCR tank, which is designed and intended to receive aqueous urea solution that is used in motor vehicles for selective catalytic reduction of the exhaust gas and thus for exhaust gas purification. An aqueous urea solution available on the market for this purpose is known by the trade name "AdBlue"®.

Furthermore, the liquid tank 10 comprises a lower shell part 18. The upper shell part 12 and the lower shell part 18 are preferably joined, for example glued or welded, to one another along a respective peripheral joining flange 24 or 26. The joining flanges 24 and 26 touch one another along a joint face 28 that is preferably planar.

The tank 10 has a tank wall 30 that surrounds a tank volume 32 in the interior of the tank 33 of the tank 10. The tank wall 30 is formed, on the one hand, by the wall 34 of the upper shell part 12 and, on the other hand, is formed by the wall 36 of the lower shell part 18.

An inner face 30*a* of the tank wall 30 forms a boundary surface of the tank wall towards the tank volume 32. The inner 30*a* in turn is formed, on the one hand, by the inner face 34*a* of the wall 34 of the upper shell part 12 and, on the other hand, is formed by the inner face 36*a* of the wall 36 of the lower shell part 18.

In the illustrated example, the tank wall 30, more precisely the wall 36 of the lower shell part 18, has on its side face a protuberance 38 on which a pump assembly 40 is seated. The pump assembly can also be arranged in the region of the bottom of the tank 10 instead of a side wall.

The pump assembly 40 comprises a first assembly component 42 which serves as a drive component 42. It comprises a component housing 44, in which a stator 46 of an electric motor is accommodated. Electrical power supply lines of the stator and a control device for operation of the stator are not illustrated in FIG. 1, but are generally known. The stator surrounds a cylindrical or conical outer surface 38*a* of the protuberance 38, so that the tank wall 30, quite generally, and the protuberance 38 with its outer surface 38*a*, in particular, form a part of the component housing 44.

A second assembly component 48 of the pump assembly 40 is provided inside the tank volume 32. As a conveying component 48, this second assembly component 48 serves to receive a movable conveying part 50, for instance a pump impeller that is merely indicated.

The conveying part 50 in the conveying component 48 can be separated by a partition 52 from an armature 54 that, together with the stator 46, forms an electric motor.

The armature rotating as the rotor 54 about the rotor axis R can comprise, with the conveying part 50, a rotor shaft 56 that is designed to transmit a rotating movement and is surrounded by a plurality of rotor magnets 58, wherein the rotor magnets 58 are preferably permanent magnets, so that the rotor 54 requires no electrical power supply.

In operation, in the stator 46 a rotating magnetic field, which magnetically couples the armature 54 and sets it in operation about the axis R, comprises electric coils of a predetermined pole pitch. The conveying component 48 is operated by the torque-transmitting connection of the rotor 56 to the conveying part 50, so that by a suction line 60, which preferably ends at the base of the tank 10, operating liquid can be drawn in and conveyed away from the conveying component 48 by a delivery line 62.

The conveying line 62 preferably passes through the tank wall 30 in a region in which the tank wall 30 is not permanently wetted by operating liquid, not even when the tank 10 is filled with its nominal amount of operating liquid. The conveying line 62 can pass through the tank wall 30 in the region of the tank top, wherein because of the low degree of wetting of the tank top a simple sealing component 64 is sufficient for sealing the point where the conveying line 62 passes through the tank wall 30. In a departure from the illustration in FIG. 1, the conveying line 62 can extend further to a dispensing point outside the tank 10, for instance an injection valve for injection of aqueous urea solution into an exhaust gas system of an internal combustion engine of a vehicle.

The tank wall 30, in particular in the region of the protuberance 38, or the protuberance 38 as a whole, can form a part of a conveying component housing (66, 166), as is illustrated in FIG. 1 for a design alternative in the upper half of the conveying component 48 (see the section of the conveying component 48 above the rotor axis R). Then, the front face 38*b* of the protuberance 38 can form a base of the conveying component housing (66, 166) which, together with the partition 52, delimits the accommodating space for the armature 54.

In the alternative embodiment of the upper half of the conveying component 48 in FIG. 1, a housing cover 66' is preferably provided that closes off the protuberance 38. A flange 66'*a* of such a housing cover 66', preferably running completely around the protuberance 38, can be glued in a liquid-tight manner to the inner face 30*a* of the tank wall 30.

Furthermore, in addition or—preferably—as an alternative to the conveying line 62, a section of the conveying line 62" can be formed integrally with the tank wall 30. Starting from the conveying part 50, a further conveying line section 62' can lead to the conveying line 62" that is formed integrally with the tank wall 30, and said further conveying line section is formed between the inner face 30*a* of the tank wall 30 and the housing cover 66' (see the configuration of the alternative embodiment of the upper half of the conveying component 48 shown by broken lines in FIG. 1).

In the embodiment illustrated in FIG. 1, the magnetic coupling between the drive component 42 and the conveying component 48 extends through the outer surface 38*a* of the protuberance 38.

Figure 2:
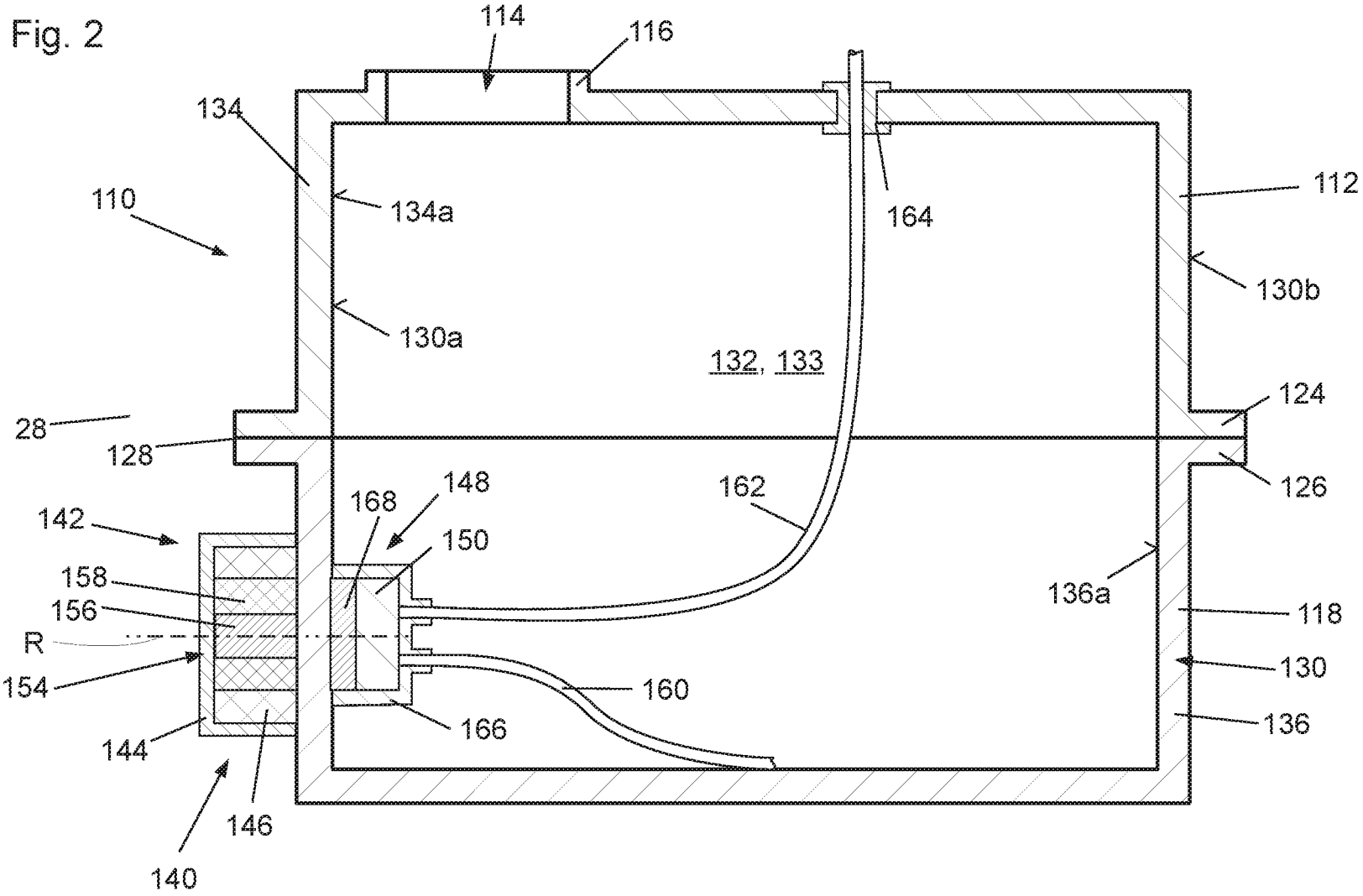

A second embodiment of an operating liquid tank 110 according to the invention is shown in FIG. 2. The second embodiment according to FIG. 2 is described below only in so far as it differs from the first embodiment according to FIG. 1, and otherwise for explanation of the second embodiment according to FIG. 2 explicit reference may be made to the description of said first embodiment. Components and component sections which are the same or functionally the same as those in FIG. 1 are given the same reference numerals in FIG. 2, but increased by the number 100.

In the second exemplary embodiment illustrated in FIG. 2, the tank wall 30 has no protuberance, but is substantially planar in the region accommodating the pump assembly 140.

In the second embodiment the armature 154 with the rotor shaft 156 and the rotor magnet 158 seated thereon also extends beyond the stator 146 in the drive component 142. Thus the drive component 142 of the second embodiment comprises the complete electric motor-powered pump drive.

Since the rotor 156 in the second embodiment is no longer coupled mechanically to the conveying part 150, in addition to the conveying part 150 a coupling part 168 connected thereto so as to transmit torque is accommodated in the conveying component 148. The coupling part 168 can be connected adhesively to the conveying part 150 for torque transmission.

The coupling part 168 can have a magnet arrangement that is polarized in such a way that it interacts with the magnetic field emanating from the armature 154, more precisely from the rotor magnet 158. Thus the magnetic coupling between the drive component 142 and the conveying component 148 takes place through the tank wall 130 between the armature 154 of the electric motor and the coupling part 168 of the conveying part 150.

Then, when the armature 154 is set in rotation by the rotating magnetic field on the stator 146, the coupling part 168 is entrained under the influence of the magnetic field that emanates from the armature 154 and then likewise rotates, so that finally the conveying part 150 is driven for rotation so that in turn operating liquid is drawn in through the suction line 160 towards the conveying part 150 and is conveyed away therefrom by the conveying line 162.

As well as an outstanding conveying effect, the sealing costs for the embodiments presented here of an operating liquid tank according to the invention are very low.

While considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

The invention claimed is:

1. An operating liquid tank for a motor vehicle, comprising a tank wall enclosing a tank volume that is fillable with an associated operating liquid, a filling arrangement designed for introducing the associated operating liquid into the tank volume, and a removal arrangement designed for the removal of the associated operating liquid from the tank volume, wherein the removal arrangement comprises a pump assembly with a pump and a pump drive, the pump assembly comprises at least two assembly components that are formed separately from one another and are coupled magnetically to one another by a magnetic coupling, the at least two assembly components including a first assembly component as a drive component that comprises at least one part of the pump drive and a second assembly component as a conveying component that comprises a conveying part of the pump that is drivable by the pump drive relative to a conveying component housing for movement, wherein the tank wall extends between the drive component and the conveying component and physically separates the conveying component located on an inner face of the tank wall from the drive component located on an outer face of the tank wall, wherein the drive component comprises at least one stator of an electric motor, wherein the conveying component comprises a rotor of the electric motor, and wherein the magnetic coupling between the drive component and the conveying component is implemented by the magnetic field existing between the stator and the rotor during operation of the electric motor.

2. The operating liquid tank according to claim 1, wherein the conveying component comprises the complete pump.

3. The operating liquid tank according to claim 1, wherein the conveying component housing completely surrounds the conveying component with the exception of through openings for passage of the associated operating liquid to the conveying part and away from it.

4. The operating liquid tank according to claim 1, further comprising a conveying line that is guided away from the conveying component through the tank wall.

5. The operating liquid tank according to claim 4, wherein a section of the conveying line is at least one of formed integrally with the tank wall and is formed between the tank wall and a part of the conveying component housing.

6. The operating liquid tank according to claim 1, wherein the conveying component housing comprises a housing component that is connected in a fluid-tight manner to a section of the tank wall.

7. The operating liquid tank according to claim 1, wherein at least one section of the conveying component is provided in a protuberance projecting outwards with respect to the surrounding tank wall.

8. The operating liquid tank according to claim 7, wherein the protuberance is at least one of a cylindrical protuberance and a conical protuberance.

9. The operating liquid tank according to claim 7, wherein at least one section of the drive component surrounds the protuberance radially externally.

10. The operating liquid tank according to claim 1, wherein at least one part of the conveying component housing is formed by a section of the tank wall.

11. The operating liquid tank according to claim 10, wherein the section of the tank wall includes a protuberance formed in the tank wall.

* * * * *